US005599132A

United States Patent [19]

Hughes, Jr.

[11] Patent Number: 5,599,132

[45] Date of Patent: Feb. 4, 1997

[54] REFLECTIVE BANDS FOR ROADWAY BARRICADE BARRELS AND METHOD OF USE

[75] Inventor: Robert K. Hughes, Jr., Cape Coral, Fla.

[73] Assignee: Flexstake, Inc., Fort Myers, Fla.

[21] Appl. No.: 474,501

[22] Filed: Jun. 7, 1995

[51] Int. Cl.[6] ..... E01F 13/00

[52] U.S. Cl. ..... 404/6; 40/306; 40/611; 40/665; 40/664; 116/63 R; 116/63 P; 404/9

[58] Field of Search ..... 404/6, 9, 10, 12, 404/14; 116/63 C, 63 P, 63 R; 40/306, 312, 611, 664, 665

[56] References Cited

U.S. PATENT DOCUMENTS

| | | | |
|---|---|---|---|
| 2,942,571 | 6/1960 | White | 116/63 C |
| 4,475,101 | 10/1984 | Kulp et al. | 404/6 |
| 4,674,431 | 6/1987 | Cory | 116/63 P |
| 5,448,846 | 9/1995 | Peterson et al. | 40/663 |

FOREIGN PATENT DOCUMENTS

| | | | |
|---|---|---|---|
| 1078785 | 8/1967 | United Kingdom | 116/63 P |
| 2271594 | 4/1994 | United Kingdom | 404/9 |

*Primary Examiner*—Henry A. Bennett
*Assistant Examiner*—Pamela A. O'Connor
*Attorney, Agent, or Firm*—James E. Bradley

[57] ABSTRACT

An apparatus and method are disclosed for providing easily replaceable reflective surfaces for highway barricade barrels. A plurality of plastic bands are provided for securing around the exterior surfaces of the barricade barrels. The plastic bands have outer sides through which a plurality of holes extends. Strips of a reflective tape are secured to the outer sides of the plastic bands. The reflective tape has an adhesive backing which is used for securing the tape to the outer sides of the plastic bands. Mechanical fasteners are passed through the holes to fasten the plastic bands to the barricade barrels. The bands are fastened to the barrels with reflective surfaces of the reflective tape facing outward, away from the barricade barrels.

3 Claims, 1 Drawing Sheet

REFLECTIVE BANDS FOR ROADWAY BARRICADE BARRELS AND METHOD OF USE

BACKGROUND OF THE INVENTION

1. Field of the Invention

The present invention relates in general to replaceable reflective surfaces, and in particular to replaceable reflective surfaces for mounting on roadway barricade barrels.

2. Description of the Prior Art

Barricade barrels have been provided for use on roadways to absorb impact resulting from automobile collisions with guardrails, construction zones, cement structures, and the like. These barricade barrels are provided with reflective surfaces so that they will be highly visible to alert persons operating motor vehicles of their presence at night. Usually brightly colored reflective tapes are fastened to the barricade barrels. The reflective tape usually have an adhesive coating on one side, and a reflective outer surface on the opposite side. The reflective tape is secured to the barricade barrels by the adhesive coating.

After a period of prolonged exposure to weather, the reflective outer surfaces become worn and diminish in visibility. The reflective surfaces also become scratched and torn. This typically requires that the tape be replaced. However, it is very difficult to remove the worn tape and adhesives used to secure the worn tape. New tape usually can not be placed over and secured to the worn tape, because of wrinkles, or to the adhesives. Often, the labor for removing prior art reflective tapes and adhesives is greater than the costs of new barricade barrels. Additionally, when tape is applied directly to the barrels with adhesives, the barrels can not be recycled because the reflective sheeting from which the tape is made contaminates the barrels.

SUMMARY OF THE INVENTION

An apparatus and method provide easily replaceable reflective surfaces for highway barricade barrels. A plurality of plastic bands are provided for securing around the exterior surfaces of the barricade barrels. The plastic bands have outer sides through which a plurality of holes extends. Strips of a reflective tape are secured to the outer sides of the plastic bands. The reflective tape has an adhesive backing which is used for securing the tape to the outer sides of the plastic bands. Mechanical fasteners are passed through the holes to fasten the plastic bands to the barricade barrels. The bands are fastened to the barrels with reflective surfaces of the reflective tape facing outward, away from the barricade barrels.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
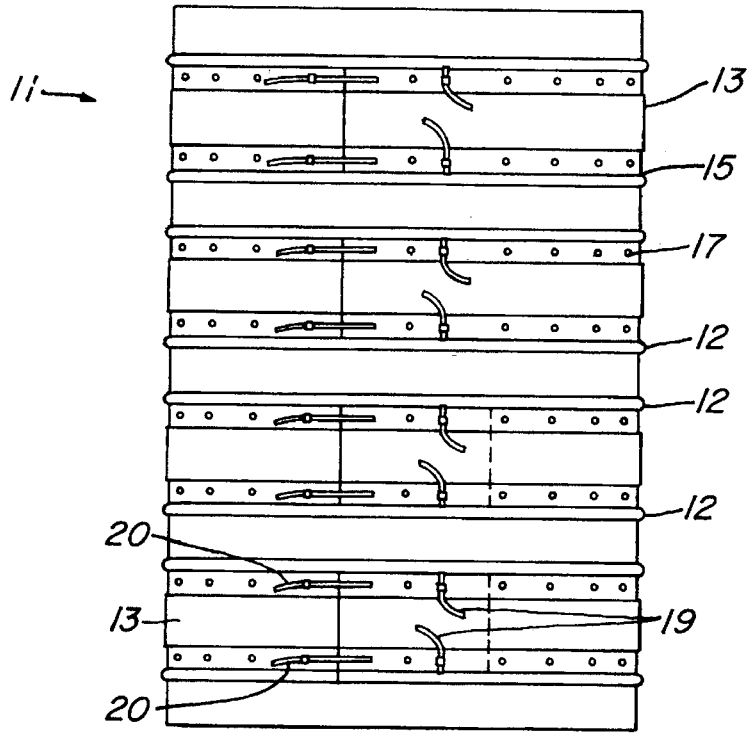
FIG. 1 is a perspective view of a barricade barrel having reflective bands mounted thereon according to the present invention.

Referring to FIG. 1, a perspective view depicts barricade barrel 11. Barrel 11 is made from plastic and partially filled with a weighting material, such as sand. Typically a two inch depth of sand is placed in the bottom of barrel 11 to provide the weighting material. Ridges 12 are formed into and extend circumferentially around the outer surface of barrel 11. A plurality of reflective bands 13 are mounted on barrel 11. Barrel 11 is initially sold with reflective bands 13, rather than with adhesive tapes mounted directly to barrel 11, so it can be recycled. Reflective bands 13 extend around circumference 15 of the outer surface of barricade barrel 11. Four or five reflective bands 13 are spaced apart along the outer surface of barrel 11, and secured to the barrel by mechanical fasteners, such as either rivets 17 or plastic ties 19, 20. FIG. 1 depicts the top two of reflective bands 13 as fastened to barrel 11 with rivets 17 and the lower two of reflective bands 13 as fastened to barrel 11 with plastic ties 19, 20.

Figure 2:
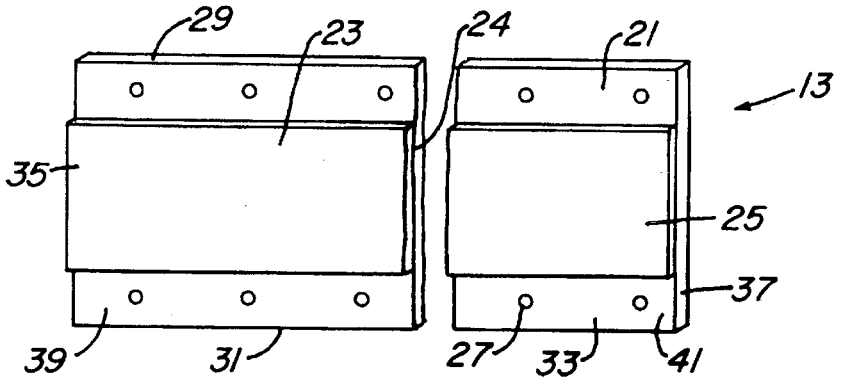
FIG. 2 is a cut-away perspective view of one of the reflective bands made according to the present invention.

FIG. 2 is a perspective view, partially cut away, depicting one of reflective bands 13. Each reflective bands 13 comprises a singular flexible plastic backing strip 21. Backing strip 21 is preferably orange in color to match the color of the barrel, and measures six (6) inches wide. A four (4) inch wide strip of reflective tape 23 is mounted on an outer surface of plastic backing strip 21. Reflective tape 23 has an adhesive coating 24 which adheres to plastic backing strip 21, and an outer reflective surface 25. Holes 27 extend along edges 29, 31 and through outer side 33 of plastic backing 21. Each backing strip has opposite ends 35, 37 and terminal ends 39, 41 which preferably overlap when band 13 is secured to barrel 11.

Referring again to FIG. 1, mechanical fastening means for securing reflective bands 13 to barrel 11 are provided by pop rivets 17. Rivets 17 extend through holes 27 through apertures extending into the sidewall of barrel 11. Plastic or metal washers may be used as a backing for rivets 17 inside of barrel 11, as well as on the outer surface 25 of reflective bands 13.

Alternatively, plastic ties 19, 20 may be used as a mechanical fastening means to secure bands 13 to barrel 11 rather than using rivets 17. The terminal end portions of the lower two reflective bands 13 are shown as being overlapped and then ties 19, 20 are passed through a portion of the holes 27 in the terminal end portions to tie ends 35, 37 (shown in FIG. 2) together and secure the lower two of bands 13 around barrel 11. Two of plastic ties 19 extend through holes 27, one on top and the other on bottom, to secure the inward overlapped end for each of the bottom two of reflective bands 13. Two more of plastic ties 20 extend through holes 27, on top and another on bottom, to secure the outward overlapped end for each of the bottom two of reflective bands 13.

Other alternative mechanical fasteners may be used to secure bands 13 to barrel 11, such as snaps or clips. Singular types or different combinations of mechanical fasteners may be used. FIG. 1 depicts two separate types of mechanical fastener, rivets 17 and plastic ties 19, 20 for illustrative purposes only.

Reflective bands 13 extend fully around the circumference 15 of barricade barrel 11 and overlap on the terminal ends. Ridges 12 circumferentially extend around the exterior of barrel 11 and provide shoulders which may be used to support reflective bands 13 on barrel 11. Others barricade barrels may have completely smooth exterior surfaces. For barricade barrels with completely smooth exterior surfaces, it is preferable that reflective bands 13 be rivetted.

In operation, barricade barrel 11 may have previously had a prior art reflective tape secured thereto by means of adhesive. The adhesives for securing such reflective tapes to barricade barrels typically are very difficult to remove. Rather than stripping the prior art reflective tape from barricade barrel 11, reflective bands 13 according to the present invention may be placed around circumference 15 of barricade barrel 11, with reflective surfaces 14 facing outward, away from barrel 11.

Mechanical fasteners, such as rivets 17 or plastic ties 19, 20, are utilized to secure reflective bands 13 to barricade barrel 11. Upon wear and deterioration of reflective bands 13, the mechanical fasteners may be easily removed by drilling, cutting, or such other means to remove worn reflective bands 13 from barricade barrel 11. New reflective bands 13 may then be secured around barricade barrel 11, providing reflective surfaces for barricade barrel 11.

The present invention provides several advantages over the prior art. Reflective bands made according to the present invention may be fastened to barricade barrels without removal of the old adhesive holding worn reflective tapes to the barricade barrels. Mechanical fasteners are utilized to secure the reflective bands to the barricade barrels, rather than adhesives, so that removal of the old adhesives from the barrels will not be required. Further, upon weathering of the reflective bands of the present invention, the mechanical fasteners may be easily removed and the reflective bands may be replaced with new reflective bands. Thus, labor for removing prior art reflective tape and adhesives from barricade barrels is avoided, making it more cost effective to rework and refurbish barricade barrels. Barricade barrels initially sold with reflective bands of the present invention, and not with adhesive tapes mounted directly to the barrels, can be recycled without the adhesive tapes contaminating recycled materials of the barrels.

Although the invention has been described with reference to specific embodiments, this description is not meant to be construed in a limiting sense. Various modifications of the disclosed embodiments as well as other alternative embodiments of the invention will become apparent to persons skilled in the art upon reference to the description of the invention. It is therefore contemplated that the appended claims will cover any such modifications or embodiments that fall within the true scope of the invention.

I claim:

1. A highway barricade, comprising in combination:

a plastic barrel at least partially filled with a weighting material;

a plurality of flexible bands, each of the bands being a flat strip having an upper edge, a lower edge, an inner side, an outer side, and two terminal ends;

a reflective surface disposed on the outer side of each of the bands;

a hole formed in the band adjacent each of the terminal ends;

mechanical fastening means for insertion through the hole adjacent each of the terminal ends for releasably securing each of the bands, spaced apart, about the exterior of the barrel, with the reflective surfaces facing outward from the barrel; and wherein the mechanical fastening means comprises rivets which are passed through at least some of the holes in the bands and through apertures in the barrel to secure the bands to the barrel.

2. An apparatus for providing reflective surfaces for a highway barricade barrel, comprising in combination:

a plurality of plastic bands, each being a strip having inner and outer sides, upper and lower edges, and two terminal ends, each of the bands having a row of holes extending therethrough along each of the edges adjacent the terminal ends;

reflective tapes having reflective surfaces mounted by adhesive to outer sides of the bands with the reflective surfaces facing outward from the bands;

fastening means for passing through the holes to secure the bands, spaced apart, about the exterior of the barricade barrel, with the reflective surfaces of the reflective tapes facing outward from the barricade barrel and with the inner sides in nonadhering contact with the barrel; and wherein the fastening means comprises:

rivets for passing through at least some of the holes in the bands and through apertures in the barricade barrel to secure the bands to the barricade barrel.

3. A method for providing night visibility for a highway barricade barrel, comprising in combination the steps of:

providing a plurality of flexible bands, each having inner and outer sides and two terminal ends;

providing a plurality of holes in the band adjacent each of the terminal ends;

placing reflective surfaces on the outer sides of the bands;

placing the bands circumferentially around the exterior of the barricade barrel, spaced apart from each other, with the reflective surfaces and outer sides facing outward, away from the barricade barrel;

fastening the bands to the exterior of the barricade barrel by inserting at least one mechanical fastener through at least some of the holes; and wherein the step of fastening the bands to the barricade barrel comprises passing rivets through at least some of the holes and through apertures provided in the barricade barrel.

* * * * *